United States Patent [19]

Burns, Jr.

[11] 4,422,355

[45] Dec. 27, 1983

[54] SPARKLING WINE BOTTLE OPENER

[76] Inventor: William T. Burns, Jr., 175 E. Delaware Pl., Apt. 6017, Chicago, Ill. 60611

[21] Appl. No.: 253,673

[22] Filed: Apr. 13, 1981

[51] Int. Cl.[3] ..... B67B 7/02

[52] U.S. Cl. ..... 81/3.36; 81/3.38 R; 81/3.31

[58] Field of Search ..... 81/3.31, 3.32, 3.34, 81/3.35, 3.36, 3.38 R, 3.4, 3.41, 3.42, 3.1 R, 3.1 A, 3.1 B, 3.1 C, 3.1 D; 7/151; 30/1.5

[56] References Cited

U.S. PATENT DOCUMENTS

| | | | |
|---|---|---|---|
| 1,620,739 | 3/1927 | Presho | 81/3.42 X |
| 2,093,658 | 9/1937 | Hildenbrand | 81/3.42 X |
| 2,162,445 | 6/1939 | Richel | 81/3.36 X |
| 2,761,338 | 9/1956 | Hardy | 81/3.38 R |
| 3,722,327 | 3/1973 | Strassel | 81/3.36 X |
| 3,800,345 | 4/1974 | Feliz | 81/3.1 R X |
| 4,052,917 | 10/1977 | Gee | 81/3.42 |

*Primary Examiner*—Frederick R. Schmidt
*Assistant Examiner*—Debra S. Meislin
*Attorney, Agent, or Firm*—Kinzer, Plyer, Dorn & McEachran

[57] ABSTRACT

A device for controllably removing a bottle stopper from a bottle containing a liquid and natural high pressure gas, such as a sparkling wine, in which the stopper is conventionally held in place, at least in part, by a wire hood. There is a clamp for gripping the bottle adjacent the pouring lip, but free of the wire hood. There is also a clamp for gripping the stopper, which clamp will permit a loosening of the wire hood. There is a handle for applying an axial turning movement to the gripping device to torsionally remove the stopper from the bottle opening, which removal is under control and at no time will permit an uncontrolled discharge of the stopper.

2 Claims, 5 Drawing Figures

SPARKLING WINE BOTTLE OPENER

SUMMARY OF THE INVENTION

The present invention relates to an opener or a device for opening a sparkling wine bottle and particularly to a device for controllably removing the stopper in a manner to prevent the uncontrolled discharge of the stopper from the bottle opening.

A primary purpose of the invention is a device of the type described which is arranged to grip the wine bottle at the neck while the wire hood is still attached to the stopper; to simultaneously grip the stopper itself after which the wire hood can be loosened, and then to remove the stopper after loosening the wire hood, but in a controlled and careful manner.

Another purpose is a simply constructed reliably operable device for removing the stopper of a sparkling wine bottle which does not require the wire hood to be loosened or otherwise detached until the stopper is firmly under control of the device.

Another purpose is a sparkling wine bottle opener which applies a torsional or twisting movement to the bottle stopper during removal which permits a controlled release of the natural gas within the bottle.

Other purposes will appear in the ensuing specifications, drawings and claims.

BRIEF DESCRIPTION OF THE DRAWINGS

The invention is illustrated diagramatically in the following drawings wherein.

DESCRIPTION OF THE PREFERRED EMBODIMENT

Sparkling wine bottles contain normal and natural high pressure gas. To contain the liquid within the bottle or container under this high pressure, a wire hood is customarily placed over the bottle stopper and secured by twisting or crimping it under the lip of the bottle. To open the bottle the wire hood must first be removed and the stopper twisted or pulled out manually.

Because of the high pressure, however, many labels carry a warning to consumers to point the bottle away from themselves and others when removing the cork or stopper, using such words as "caution" or the like and advising that the stopper be held or grasped firmly during removal. Unfortunately, simply grasping the stopper firmly does not prevent it from being forcibly and unexpectedly expelled by the high pressure, sometimes even as the wire hood is being removed, and particularly, as happens on many occasions, if the stopper cannot be removed or even moved without using pliers or some other device. The results of such an unexpected discharge of the stopper have been injurious to both the person opening the bottle and those who may be nearby. As oftentimes happens, if gas is built up in the bottle by inadvertent shaking or the like, a substantial portion of the bottle contents are lost during the opening process.

The present invention provides a means for opening a sparkling wine bottle in such a manner that the gas within the bottle is released on a controlled basis and it is impossible for the stopper to be accidentally discharged or expelled during the opening process. The device includes means for first gripping the neck of the bottle adjacent or near the pouring area. There are means for gripping the stopper, which means will not interfere with a loosening of the wire hood. In the same context, the means for gripping the neck of the bottle will not interfere with a loosening of the wire hood. Thus, once the neck and the bottle stopper have been firmly gripped, then and only then is the wire hood loosened. Once the hood has been loosened, there are means for controllably turning or twisting or torsionally moving the bottle stopper along with the loosened wire hood in such a manner as to slowly remove it from the bottle opening, permitting the controlled seepage or leakage of gas from within the bottle. The safety device or wire hood is never removed or released from the bottle neck until the stopper is fully controlled which will prevent any accidental removal or unexpected discharge of the stopper.

Figure 1:
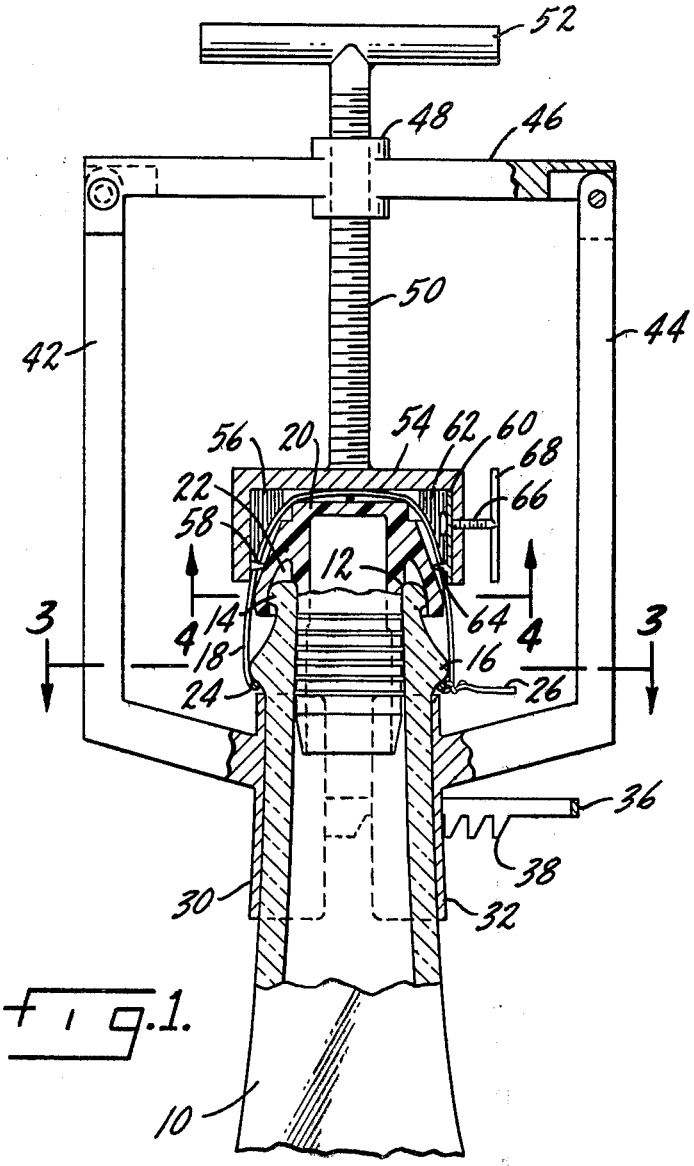
FIG. 1 is a diagrammatic illustration in partial section of the neck of a sparkling wine bottle, showing the bottle stopper and wire hood in position and illustrating the device of this invention attached to the wine bottle for stopper removal.
Figure 2:
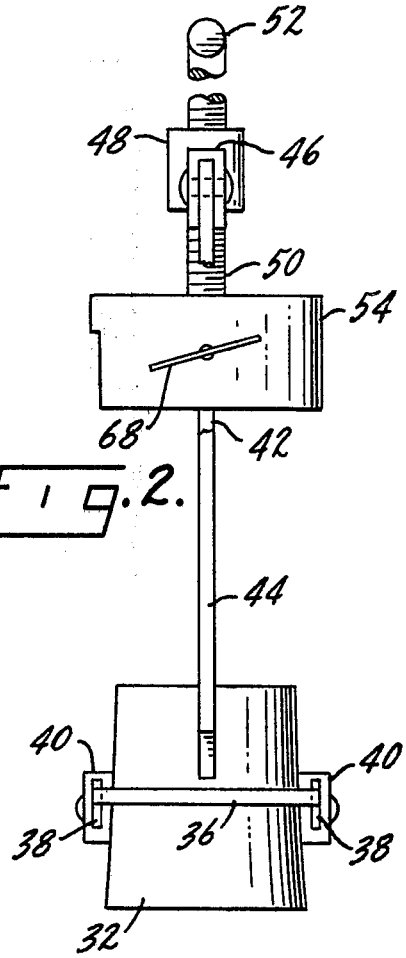
FIG. 2 is a side view of the stopper removal device illustrated in FIG. 1, with a portion broken away for clarity.

Looking at FIG. 1, the neck of a wine bottle is indicated generally at 10 and the wine bottle is of the type mounting a plastic bottle stopper. It should be understood that the invention is equally applicable to cork bottle stoppers. The pouring lip of the neck 10 is indicated at 12 and there is a small outwardly-directed flange 14 directly adjacent the pouring opening. Spaced slightly from the flange 14 is a somewhat larger outwardly-extending projection or flange 16 which will mount the wire hood indicated at 18. A stopper is indicated at 20 and is the plastic type. Such a stopper has an internal annular groove 22 which fits over flange 14. Customarily, as indicated in FIG. 1, stopper 20 will be inserted into the opening of the bottle with the flange 14 adjacent the bottle opening extending into groove 22. The wire hood 18 will extend over the stopper and will have a circumferentially extending wire 24 which encircles the bottle neck beneath flange 16 and it is at this point that one or more ties 26 may be twisted to firmly attach the wire hood to the stopper and the neck of the bottle.

Figure 3:
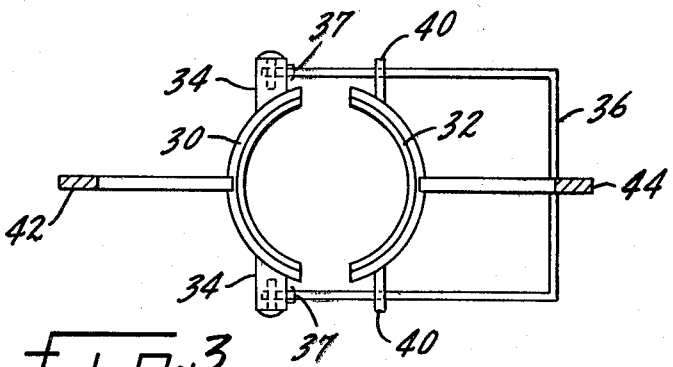
FIG. 3 is a section along plane 3—3 of FIG. 1, with the bottle not shown.

A pair of clamp members 30 and 32, which are generally curved or arcuate in cross section, as particularly illustrated in FIG. 3, are positioned to grip or be clamped upon the exterior of the bottle neck, beneath flange 16. Clamp member 30 has a pair of oppositely disposed extensions 34 which pivotally mount the opposite ends of a handle 36, the bottom surface of which has a ratchet 38 formed thereon. Clamp member 32 has outwardly-extending arms 40 which are formed and adapted to cooperate with the ratchet 38 to variably position clamp 32 relative to clamp 30, thus to attach the clamps to bottles with necks of varying diameter. Although not shown, in some applications the inside surfaces of clamps 30 and 32 may have a covering of a soft material, such as rubber. Small springs or the like 37 may cooperate between handle 36 and extensions 34 bias the handle down upon arms 40.

Clamps 30 and 32 have upwardly-extending brackets 42 and 44, respectively, which are pivotally attached at their upper ends to a cross bar 46. Cross bar 46 has a centrally positioned boss 48 which is internally threaded to mount a screw member 50, the upper end of which supports a handle 52.

Figure 4:
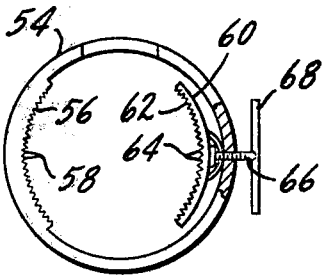
FIG. 4 is a bottom view of the cup-shaped member or hood used to grip the bottle stopper as viewed along plane 4—4 of FIG. 1.

A cup-shaped member or hood 54 is attached to the lower end of screw 50 and, as illustrated in FIG. 1, is of a size and shape to enclose the upper end of the bottle stopper. Member 54, as illustrated particularly in FIG. 4, may have a serrated internal curved surface 56 on one side thereof, which surface also includes an inwardly-extending projection 58. The opposite side of member 54 mounts a movable gripping member 60 having a serrated surface 62 and an inwardly-extending projection 64. A small screw 66 extending through the side of member 54 and having a handle 68 exteriorly thereof is used to variably position gripping member 60 relative to the serrations and projection at the opposite side of member 54 to thereby grip the bottle stopper and to accomodate stoppers of various sizes and shapes.

Figure 5:
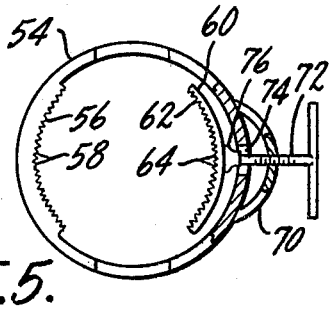
FIG. 5 is a partial sectional view, similar to FIG. 4, but illustrating a variant form of the invention.

A variant form of stopper gripping device is illustrated in FIG. 5. In this case there is an external bracket 70 which mounts a screw 72 supporting the gripping member 60. There is an opening 74 in the side wall of member 54 and a small boss or the like 76 on gripping member 60 which may fit within the opening 74. The device of FIG. 5 functions in all respects in a manner similar to that of the gripping device of FIG. 4.

In use, it is important to remember that the device is applied to a wine bottle prior to the time that the wire-hood is loosened. The wire must stay in place in order to obtain its protection against unexpected removal of the stopper. First, the clamps 30 and 32 are applied to opposite sides of the bottle neck in the area indicated. As bottles having a cork stopper may not have quite the same neck configuration as illustrated in FIG. 1, the clamps may be applied in a slightly variant position. In any event the clamps are always applied to the bottle neck below the point where the wirehood terminates so as not to hinder its removal. The clamps are firmly attached to the bottle neck through the cooperation of handle 36, its ratchet area 38 and the arm extensions 40 of clamp 32.

Once the clamps are firmly upon the bottle neck, then hood or cup-shaped member 54 is screwed downwardly from an initial raised position until it rests upon the top of the stopper. It is important to note that the bottom of hood 54 is just about at the location of the pouring lip of the bottle. Serrations 56 and projection 58 will grip one side of the stopper and the serrations 62 and projection 64 at the opposite side will be manually adjusted until both sides of the stopper are firmly gripped. In this connection the mechanical connection between screw 66 and movable gripping member 60 provides for member 60 to move toward and away from the stopper, but prevents any rotation of member 60. The serrations and projections will actually penetrate a cork stopper, whereas, in the case of a plastic stopper the projections will fit within and penetrate the conventional grooves formed in such a stopper.

Once the gripping members of hood 54 are firmly in engagement with the bottle stopper, it is then safe to loosen the wire hood. The twisted areas 26 are released and circumferential wire 24 is pulled outwardly away from beneath flange 36 so that the wire is no longer holding the stopper to the bottle. It should be noted that neither the clamps nor the hood in any way restrict the loosening and removal of the wire.

Once the wire has been loosened, handle 52 is rotated to controllably twist or torsionally remove the stopper from the bottle opening. The torsional movement of the stopper is important in that by so doing, that portion of the stopper within the bottle will be squeezed to some extent providing a controlled release of the gas within the bottle. Thus, the gas will slowly be released as the stopper is removed. There is no possibility of the stopper being unexpectedly discharged because it is firmly held by the hood in tandem with the neck clamps.

It is important to note that the device simultaneously holds both the neck of the bottle and the stopper firmly before the wire hood is released. The release of the gas and removal of the stopper is controlled. The invention clearly should not be limited to the precise mechanical configuration illustrated, as there are many variations which will come within the scope of the invention.

A search made prior to the filing of the application disclosed the following references: U.S. Pat. Nos. 2,761,338, 580,639, 664,565, 1,253,867, 2,305,995 and 2,450,293. Of these patents it is believed that U.S. Pat. No. 2,761,338 is the most pertinent.

Whereas the preferred form of the invention has been shown and described herein, it should be realized that there may be many modifications, substitutions and alterations thereto.

The embodiments of the invention in which an exclusive property or privilege is claimed are described as follows:

1. Means for controllably removing a bottle stopper from a bottle containing a liquid and natural high pressure gas, such as a sparkling wine, in which the stopper is held in place, at least in part, by a wire hood, including a pair of oppositely-positioned clamping members, each having a generally curved surface for gripping the bottle adjacent the pouring lip, but free of the wire hood, means for moving said clamping members toward and away from an intermediately positioned bottle, means for gripping the stopper, which means permits a loosening of the wire hood, including a cup-shaped member having movable interior gripping means, a threaded member mounted upon said clamping members, said cup-shaped member being mounted upon said threaded member for movement toward and away from the stopper, and means for applying an axial turning movement to said cup-shaped member to slowly move it relative to the clamping members and remove the stopper and permit the controlled release of gas from within the bottle after the wire hood has been loosened and while maintaining the clamping members in clamping engagement with the bottle adjacent the pouring lip.

2. The structure of claim 1 further characterized in that said interior gripping means includes a fixed projection and a movable projection positioned oppositely thereto, and means for moving said movable projection toward and away from an intermediately position bottle stopper.

* * * * *